US011788518B1

(12) United States Patent
Henry et al.

(10) Patent No.: US 11,788,518 B1
(45) Date of Patent: Oct. 17, 2023

(54) LOW-PROFILE SOLAR-POWERED FLOOD CONTROL DEVICE

(71) Applicants: David H. Henry, Houston, TX (US); Peter A. Henry, Houston, TX (US)

(72) Inventors: David H. Henry, Houston, TX (US); Peter A. Henry, Houston, TX (US)

( * ) Notice: Subject to any disclaimer, the term of this patent is extended or adjusted under 35 U.S.C. 154(b) by 0 days.

(21) Appl. No.: 18/324,746

(22) Filed: May 26, 2023

(51) Int. Cl.

| | |
|---|---|
| ***F04B 17/00*** | (2006.01) |
| ***E01F 5/00*** | (2006.01) |
| ***F04B 19/04*** | (2006.01) |
| ***F04B 51/00*** | (2006.01) |
| ***F04B 53/16*** | (2006.01) |
| ***F04B 53/20*** | (2006.01) |
| ***F04D 29/40*** | (2006.01) |

(Continued)

(52) U.S. Cl.
CPC ..... *F04B 17/006* (2013.01); *E01F 5/00* (2013.01); *F04B 19/04* (2013.01); *F04B 49/02* (2013.01); *F04B 51/00* (2013.01); *F04B 53/16* (2013.01); *F04B 53/20* (2013.01); *F04D 13/068* (2013.01); *F04D 29/406* (2013.01); *F04B 2207/70* (2013.01)

(58) Field of Classification Search
CPC ..... F04B 17/006; F04B 19/04; F04B 49/02; F04B 51/00; F04B 51/20; F04D 13/068; F04D 29/406; F04D 2207/70; E01F 5/00
See application file for complete search history.

(56) References Cited

U.S. PATENT DOCUMENTS 3,717,420 A * 2/1973 Rachocki ..... F04D 13/08 417/12
4,835,664 A 5/1989 Wen
(Continued)

FOREIGN PATENT DOCUMENTS

CN 211531053 U 9/2020
CN 210597455 U 5/2022
EP 2236066 A2 * 6/2010

OTHER PUBLICATIONS

Wayback Machine capture of 3M™ Raised Pavement Marker Series 290, 3M Science, Applied to Life™, 6 pages, dated Apr. 19, 2023, available at https://www.3m.com/3M/en_US/p/d/b00010878, accessed on Aug. 25, 2023 via https://web.archive.org/web/20230419215235/https:/www.3m.com/3M/en_US/p/d/b00010878/.
(Continued)

*Primary Examiner* — Charles G Freay
(74) *Attorney, Agent, or Firm* — McDermott, Will & Emery LLP

(57) ABSTRACT

Embodiments of the present invention are directed to a low-profile solar-powered flood control device suitable for use on public roads, sidewalks, parking lots, and similar areas subject to pedestrian and vehicle traffic comprising a two-part housing with a low-profile cover and a mounting plate, a solar panel, a battery, a controller, a pump unit, inlet holes, inlet filters, a hose, and pump-hose connections. The low-profile cover is provided with separate battery and pump compartments to isolate the battery and controller from the pump unit and any water drawn into the housing. The flood control device may include a sensor for detecting the presence of water and turning the pump unit on and off. The controller is connected to the solar panel and the pump unit and may be configured to optimize battery charging for poor or indirect lighting conditions.

20 Claims, 9 Drawing Sheets

(51) Int. Cl.
*F04D 13/06* (2006.01)
*F04B 49/02* (2006.01)

(56) References Cited

U.S. PATENT DOCUMENTS

| | | | | |
|---|---|---|---|---|
| 5,055,984 | A | 10/1991 | Hung et al. | |
| 6,210,017 | B1 | 4/2001 | Miura et al. | |
| 6,406,163 | B1 | 6/2002 | Yang | |
| 6,729,742 | B2 | 5/2004 | Wismeth et al. | |
| 7,695,251 | B2 | 4/2010 | Marioni | |
| 8,545,194 | B2 | 10/2013 | Irving et al. | |
| 9,222,634 | B2 | 12/2015 | Zhu | |
| 9,494,159 | B2 * | 11/2016 | Bryditzki | F04B 17/006 |
| 9,945,366 | B1 * | 4/2018 | McLaughlin | B60L 1/003 |
| 10,309,394 | B1 | 6/2019 | Martin et al. | |
| 11,318,491 | B2 | 5/2022 | Chen et al. | |
| 2002/0104807 | A1 | 8/2002 | Keeton | |
| 2005/0133088 | A1 | 6/2005 | Bologeorges | |
| 2006/0269426 | A1 * | 11/2006 | Llewellyn | F04D 13/068 417/411 |
| 2007/0048152 | A1 | 3/2007 | Conally | |
| 2007/0102534 | A1 | 5/2007 | Wigglesworth et al. | |
| 2010/0303654 | A1 | 7/2010 | Petersen et al. | |
| 2010/0206397 | A1 | 8/2010 | Hewitt | |
| 2011/0174897 | A1 | 7/2011 | Mai | |
| 2015/0064022 | A1 | 3/2015 | Cobo | |
| 2015/0274559 | A1 | 10/2015 | Burton et al. | |
| 2016/0201643 | A1 | 7/2016 | Blake | |
| 2016/0377069 | A1 | 12/2016 | Spadotto et al. | |
| 2018/0094624 | A1 * | 4/2018 | Kabasta, Jr. | F04B 53/10 |
| 2018/0163716 | A1 | 6/2018 | Bae | |
| 2022/0008950 | A1 | 5/2022 | Chen et al. | |
| 2022/0136523 | A1 | 5/2022 | Weber et al. | |

OTHER PUBLICATIONS

Wayback Machine capture of "Aluminum Solar Road Stud NK-RS-D1," Shenzhen Nokin Traffic Facilities Co., Ltd., 7 pages, dated Feb. 1, 2023, available at https://www.nk-roadstud.com/products/solar-road-stud/nk-rs-d1.html, accessed on Aug. 25, 2023 via https://web.archive.org/web/20230201133422/https:/www.nk-roadstud.com/products/ solar-road-stud/nk-rs-d1.html.

* cited by examiner

LOW-PROFILE SOLAR-POWERED FLOOD CONTROL DEVICE

TECHNICAL FIELD

The present disclosure generally relates to a low-profile solar-powered flood control device for evacuating water in low-lying areas, and more specifically to a low-profile solar-powered flood control device with a protective, impact-resistant housing designed to be quickly and easily installed in high impact areas that are likely to be subject to pedestrian and vehicle traffic, such as the curb area on neighborhood roads.

BACKGROUND

Sump pumps are designed to capture pooling water and relocate the water to another area. A sump pump is usually provided indoors in a basement or crawl space, where it is installed in a pit and connected to a network of pipes for channeling water away from a home's foundation. A sump pump may also be installed outdoors in the backyard of a home, where it takes pooling rainwater from the yard and drains it to another location to relieve flooding. Conventional outdoor sump pumps, however, are not highly transportable nor are they suitable for applications beyond backyard use because they must generally be installed in a pre-constructed underground pit. The pit must often be located near a fixed power source and include buried pipes for collecting and transporting water away from the flooded area.

In regions with medium to high rainfall, low-lying areas of public roads, sidewalks, and parking lots are susceptible to accumulating pooling water. For example, gravity-operated curb drainage systems used on neighborhood streets may stop working properly when the roads heave and shift (typically due to heavy rains) and low spots develop. The resulting low spots in roads, driveways and parking lots may retain water for weeks, creating dozens of areas of foul standing water within a single neighborhood. The problem is exacerbated in areas with more frequent or heavier rainfall. While a single pool of standing water in a neighborhood may not appear to create much harm, dozens of standing pools combine to create an unsightly health hazard. Further, the continuous cycle of road repairs combined with natural deterioration results in a "moving target" as to where low-lying areas develop. Thus, the distributed nature of the problem, combined with the fluctuating locations of low-lying areas, makes the installation of traditional sump pumps and accompanying power and piping infrastructure uneconomic, impractical, and ineffective. Finally, typical sump pumps are also unable to efficiently manage very shallow pools of water, which may tend to develop on moderately low-lying areas of a neighborhood road on a more regular basis and during periods of normal rainfall.

Accumulated water in low-lying areas of roads, sidewalks, and parking lots poses a significant risk to pedestrians and drivers and may cause further damage to roads and vehicles. In neighborhoods with multiple areas of accumulated water, the unsightly pools generate foul odors, provide breeding areas for insects and pathogens, and create significant slip hazards—especially for children and the elderly. Further, roads and infrastructure deteriorate further when standing water is not promptly and adequately remediated. Traditional pump systems that may be implemented to temporarily relieve this pooled water—although rarely used for this purpose—may also form obstructions in these areas, making navigation around the pumps and associated power supplies difficult and dangerous. Thus, there is a need for an efficient, easy to install, low maintenance, and low-profile outdoor sump pump adapted for use in high-impact areas that may be subject to pedestrian and vehicle traffic, such as residential roads.

SUMMARY

According to certain aspects of the present disclosure, a low-profile solar-powered flood control device suitable for use on public roads, sidewalks, parking lots, and similar pedestrian and vehicle accessible areas is provided. The flood control device of a preferred embodiment includes a two-part housing with a low-profile cover and a mounting plate, a solar panel, a battery, a controller, a pump unit, inlet filters, a hose, and pump-hose connections. The low-profile cover is preferably provided with separate battery and pump compartments, such that the battery and controller are isolated from the pump unit and any water drawn into the housing. The housing is further provided with inlet holes that cooperate with the inlet filters to collect and filter water surrounding the flood control device.

In some embodiments, the low-profile solar-powered flood control device includes a sensor for detecting the presence of water and turning the pump unit on and off.

In some embodiments, the inlet filters are removably positioned between the outer wall of the cover and the inner wall of the pump compartment.

In some embodiments, the base plate includes a well-like dip for centralizing the collection of water.

In some embodiments, the pump unit includes a plurality of intakes and outlets.

In some embodiments, the pump unit is a centrifugal pump. In other embodiments, the pump unit is a positive-displacement pump. In still other embodiments, the pump unit is a diaphragm pump. In still other embodiments, the flood control device includes a plurality of pump units.

In some embodiments, the solar panel is mounted on the housing cover. In other embodiments, the solar panel is mounted separately from the housing.

In some embodiments, the pump unit and battery are removable.

In some embodiments, the battery compartment is potted with a suitable epoxy, silicone, or polyurethane compound.

In some embodiments, the controller optimizes battery charging by the solar panel for poor or indirect lighting conditions.

In some embodiments, the controller includes a sensor for detecting when the controller, battery, or pump needs to be replaced, and a transmitter for wirelessly communicating with a user device for monitoring the status of the flood control device.

In some embodiments, the housing has a height that is substantially less than its width.

In some embodiments, the housing includes sloped side walls that allow the housing to be driven over by vehicles.

In some embodiments, the inlet holes are provided on one or more sides of the device. In other embodiments, the inlet holes are provided on the bottom of the device.

In some embodiments, the housing is made of thick plastic, metal, or resin.

In some embodiments, the mounting plate is fastened to the road, parking lot, or other substrate with mechanical fasteners. In other embodiments, the mounting plate is adhered to the substrate with adhesive or other materials to secure the device from theft or prevent movement when the device is driven over by a vehicle.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

Figure 1:
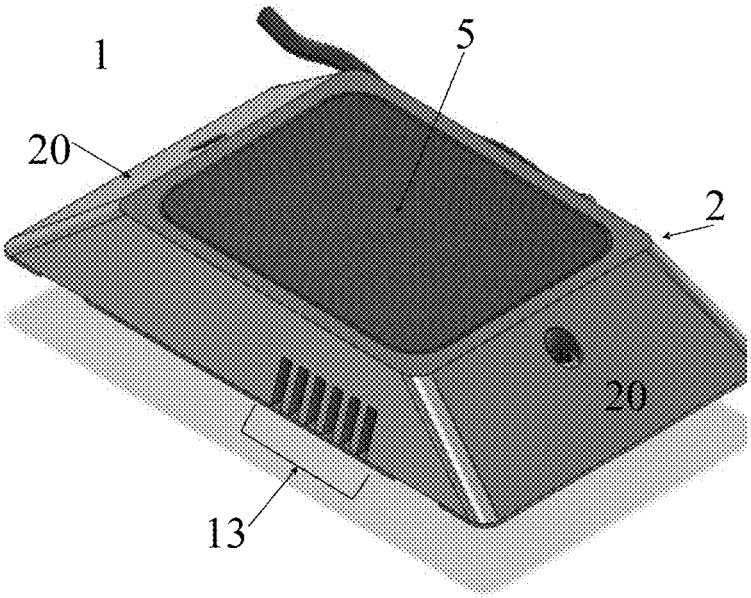
FIG. 1 is a perspective view of an embodiment of the low-profile solar-powered flood control device.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

In addition, each of the drawings is a schematic diagram and thus is not necessarily strictly illustrated. In each of the drawings, substantially the same structural components are assigned with the same reference signs, and redundant descriptions will be omitted or simplified.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. For example, while the low-profile solar-powered flood control device discussed herein may be implemented in many different forms, the disclosure will show in the drawings, and will herein describe in detail, implementations with the understanding that the present description is to be considered as an exemplification of the principles of the low-profile solar-powered flood control device and is not intended to limit the broad aspects of the disclosure to the implementations illustrated. Accordingly, the drawings and description are to be regarded as illustrative in nature and not restrictive.

Figure 5:
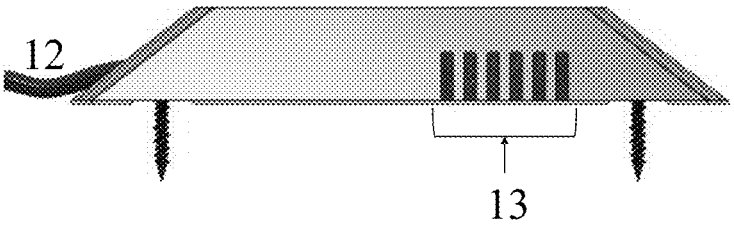
FIG. 5 is a side view of an embodiment of the low-profile solar-powered flood control device.
Figure 6:
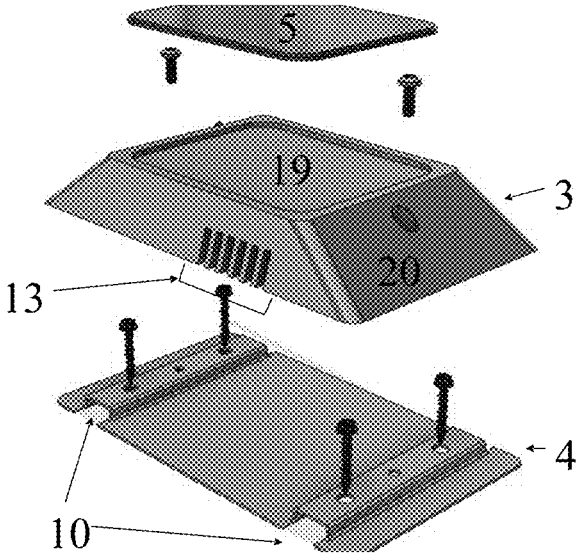
FIG. 6 is an exploded view of an embodiment of the low-profile solar-powered flood control device.

FIGS. 1-18 show various aspects of a low-profile solar-powered flood control device 1 according to a preferred embodiment of the present invention. As illustrated in FIGS. 1 and 6, the low-profile solar-powered flood control device 1 includes a housing 2 comprising a cover 3 and a mounting plate 4. The cover 3 includes a plurality of inlets 13 and sloped side walls 20 that allow the low-profile solar-powered flood control device to be safely driven over by a vehicle. The inlets 13 are sized and arranged like a grate to prevent large debris (such as fallen leaves) from entering the flood control device. The housing 2 may be reinforced by bars, bulkheads, epoxy potting, or the like to permit the flood control device to be driven over without sustaining damage. Further, as shown in FIGS. 5 and 6, the housing 2 has a generally trapezoidal cross-section, which allows a tire of a vehicle to gently and safely roll over walls 20 of the device. In a preferred embodiment, the height of the housing 2 is substantially less than the width of the housing. For example, the height may be in the range of 1.0 to 1.5 inches, or no more than ¼ of the width, and the width may be in the range of 5 inches. As another example, the housing 2 may be 8 inches long by 4.5 inches wide by 1.2 inches tall. Further, the height may be low profile enough that a standard passenger vehicle could drive over the device without impacting the stability of the vehicle or safety of the motorist. In an alternative embodiment shown in FIGS. 17 and 18, the housing 2 may be frustoconical. In a further embodiment shown in FIGS. 15 and 16, the housing 2 may be substantially frustoconical with one vertical sidewall that can be placed parallel to a curb.

The cover 3 further includes a solar panel 5, which is mounted to the top of the cover. In one embodiment, shown in FIGS. 10, 11, 13, and 14, the solar panel 5 comprises a plurality of solar panel cells that are positioned in recesses in the top of the housing that form a grid. In alternative embodiments, the solar panel is not mounted on the housing. For example, the solar panel may be remotely mounted on a nearby light pole or small mounting stick and connected to the low-profile solar-powered flood control device via a cable. The remotely mounted panel may be placed in any location that may be subject to more sunlight or other illumination, such as in an area slightly more elevated—yet nearby—the location of the flood control device 1. For example, the remotely mounted panel may be placed on an elevated stand, a raft of floating expanded foam, an inflatable platform, or other mounting options.

Figure 2:
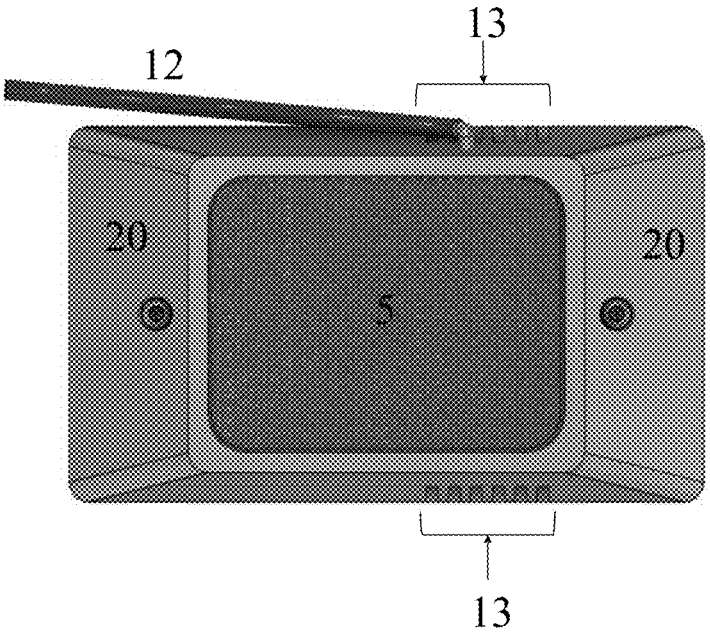
FIG. 2 is a top view of an embodiment of the low-profile solar-powered flood control device.

FIG. 2 shows a top view of the low-profile solar-powered flood control device according to the present invention. As shown in FIG. 2, the housing cover includes inlets 13 on multiple sides of the housing. The cover is further provided with through holes for attaching the cover to the mounting plate 4 via fasteners such as bolts or the like.

Figure 3:
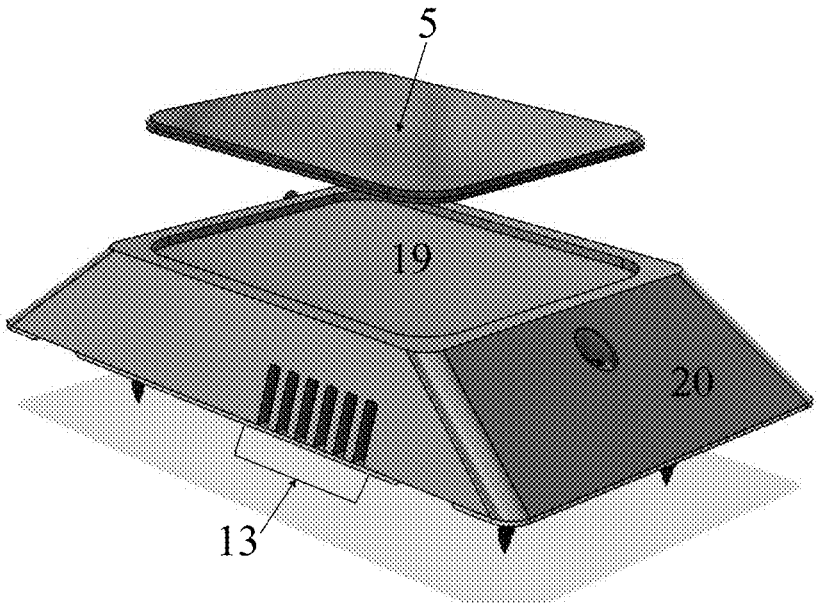
FIG. 3 is a perspective view of an embodiment of the low-profile solar-powered flood control device with the solar panel separated from the housing.
Figure 4:
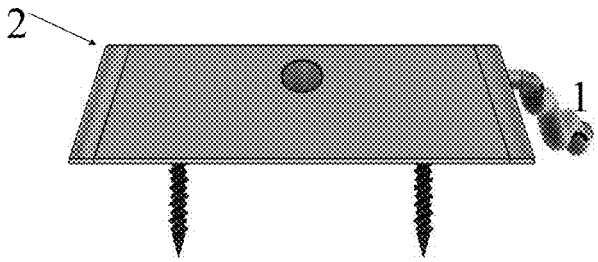
FIG. 4 is a front view of an embodiment of the low-profile solar-powered flood control device.

FIG. 3 shows a partially exploded view of the low-profile solar-powered flood control device of the present invention with the solar panel 5 separated from the housing 2. As can be seen in FIG. 3, the solar panel 5 is sized to fit on top of the housing 2 and is received in a recess 19 on the top of cover 3.

FIG. 6 also shows a partially exploded view of the low-profile solar-powered flood control device with the solar panel 5, cover 3, and mounting plate 4 separated. The mounting plate 4 includes two raised channels 10 which facilitate attaching the low-profile solar-powered flood control device to a mounting surface. In particular, the channels 10 include through holes for attaching the mounting plate to a mounting surface, such as the ground, using fasteners such as screws and the like. In an alternate embodiment, the mounting plate is attached to a mounting surface via adhesive applied to the bottom surface of the channels 10. For example, strips of adhesive, such as butyl rubber strips, may be positioned within channels 10 to attach the mounting plate to the mounting surface. The channels 10 also facilitate attachment of the cover 3 to the mounting plate 4. In a preferred embodiment, the cover 3 is removably attached to the mounting plate using fasteners which pass through holes in walls 20 of the cover 3 and channels 10 of the mounting plate 4.

Figure 7:
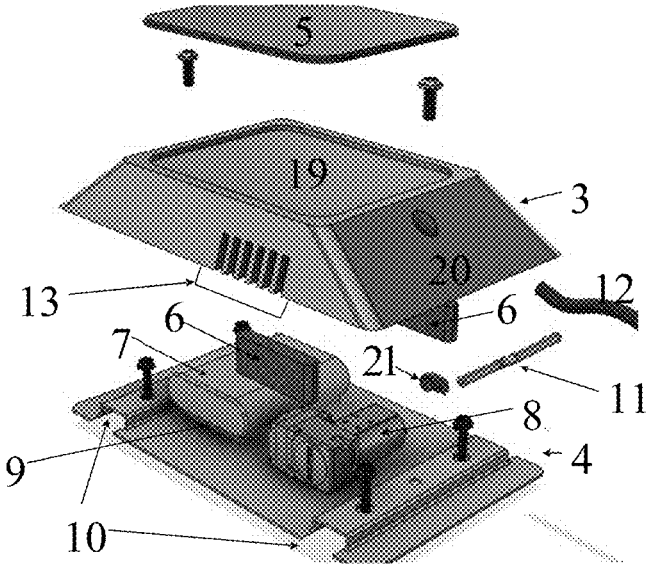
FIG. 7 is an exploded view of an embodiment of the low-profile solar-powered flood control device showing the inner components of the flood control device.

FIG. 7 shows a fully exploded view of the low-profile solar-powered flood control device, which further includes a battery 7, a controller 9, pump unit 8, inlet filters 6, suction funnel 21, pump-hose connector 11, and an output hose 12. The battery 7 may be of a conventional NiCd, NiMH, or Li-ion type, although other types of batteries or assemblies of batteries are contemplated herein. The arrangement of the above components within the low-profile solar-powered flood control device is best illustrated in FIGS. 8 and 9.

Figure 8:
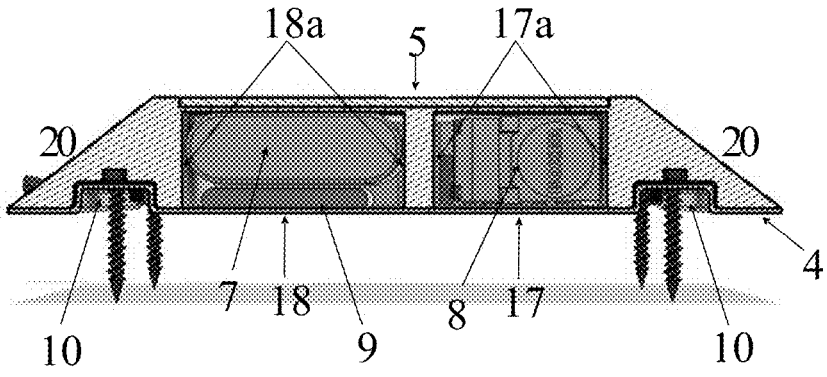
FIG. 8 is a cross-sectional side view of an embodiment of the low-profile solar-powered flood control device.

As illustrated in FIG. 8, the cover 3 of the housing includes a battery compartment 18 and a pump compartment 17. While not illustrated in the figures, the interface between the vertical sidewalls 18*a* of the battery compartment and the upper surface of the mounting plate 4 provides a water-tight seal so that water cannot enter the battery compartment 18. As a non-limiting example, such a water-tight seal could be provided by a gasket positioned between the edges of the battery compartment 18 and the mounting plate 4. It should further be understood that the electrical connections between the battery 7, controller 9, pump unit 8, and solar panel 5 pass through the housing 2 in such a way that the battery compartment 18 is watertight. In a preferred embodiment, the battery and electrical components are potted within battery compartment 18 with an epoxy compound. In such an embodiment, the epoxy-potted battery compartment 18 seals the battery and electrical components from water and provides compressive strength to the battery compartment 18 and the surrounding portions of the housing 2.

Figure 9:
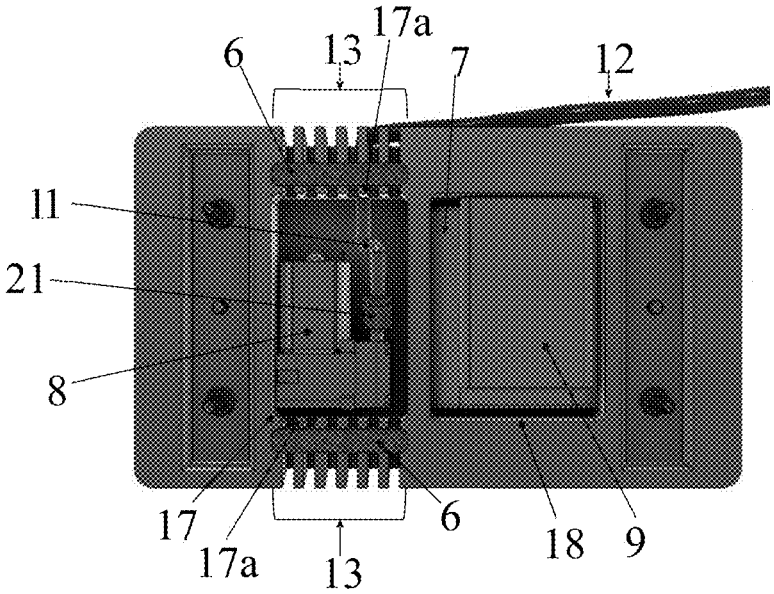
FIG. 9 is a cross-sectional bottom view of an embodiment of the low-profile solar-powered flood control device.

FIG. 9 illustrates the compartments 17 and 18 and the inlets 13 in further detail. In particular, each inlet 13 comprises a channel extending from the exterior of the cover 3 to an inner vertical side wall 17*a* of the pump compartment 17. A removable filter 6 is further provided in a receiving space 22 that extends perpendicularly across each inlet channel for filtering smaller debris from the water. During use, water enters an inlet 13 from outside the cover 3, passes through the filter 6, and flows into the pump compartment. The filter may be removed, quickly cleaned, and repositioned in the receiving space 22. In particular, a user may unscrew the fasteners holding the cover 3 to the mounting plate 4, flip the cover over, remove the filters 6, either clean or replace the filters, and reattach the cover to the mounting plate.

FIGS. 10, 11, 13, and 14 illustrate a further embodiment of the low-profile solar-powered flood control device where the solar panel 5 comprises a plurality of solar panel cells positioned within recesses on the top of housing 2 arranged in a grid 27. This embodiment may be preferred for heavier vehicle applications or applications where longer-term durability is required. The raised portions of the housing 2 that form the outline of the grid 27 minimize the load placed on the solar panel cells so that any loading on the cells is within the structural limitations for the cells. The solar panel cells are adhered to the top of the housing and wires are run from the cells into the battery compartment 18. In a preferred embodiment, the hole through which the wires are run is potted with epoxy, silicone, or another suitable material.

Figure 10:
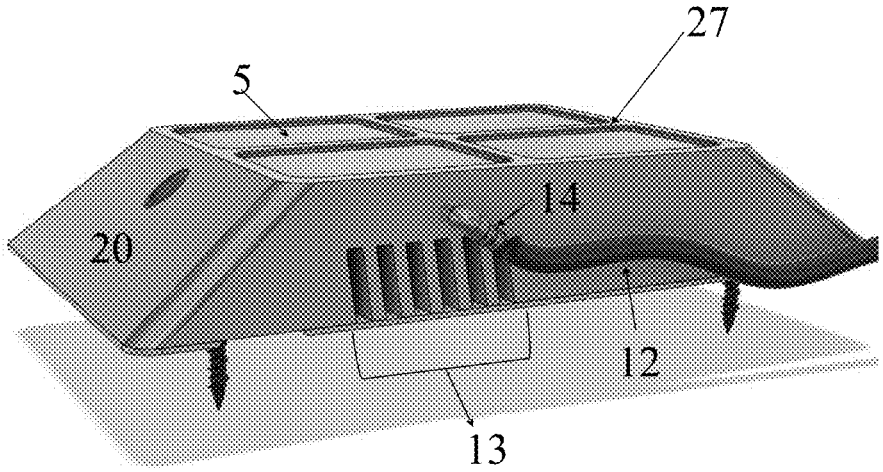
FIG. 10 is a perspective view of an embodiment of the low-profile solar-powered flood control device with a plurality of solar panel cells positioned within a recessed grid of the housing.
Figure 11:
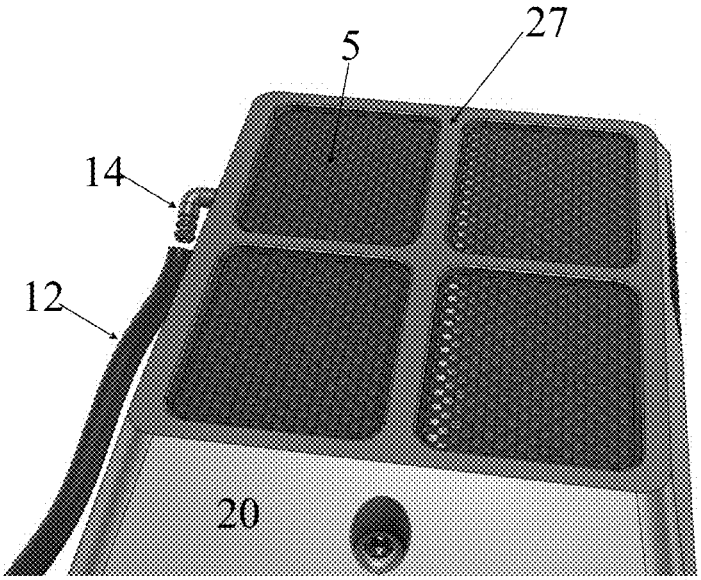
FIG. 11 is a perspective view of an embodiment of the low-profile solar-powered flood control device with a plurality of solar panel cells positioned within a recessed grid of the housing.

FIGS. 10 and 11 also provide a detailed view of the housing outlet 14. The housing outlet 14 is designed to be readily connected to a replaceable hose 12. In a preferred embodiment, the housing outlet 14 includes a barbed end that may be inserted inside hose 12 for retaining hose 12 on the housing outlet. The hose 12 may be run alongside a curb or street where it may undergo wear and tear, necessitating replacement.

Figure 12:
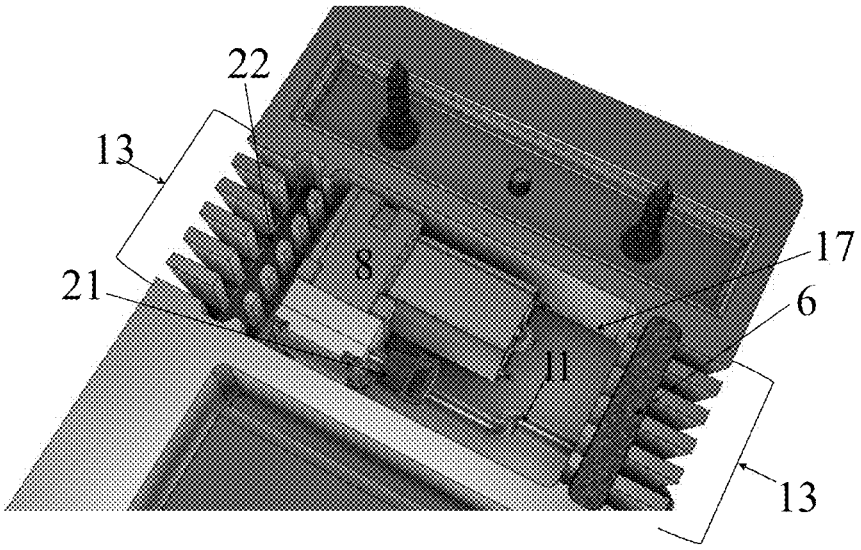
FIG. 12 is a view of an embodiment of the low-profile solar-powered flood control device showing the inner components of the flood control device.
Figure 13:
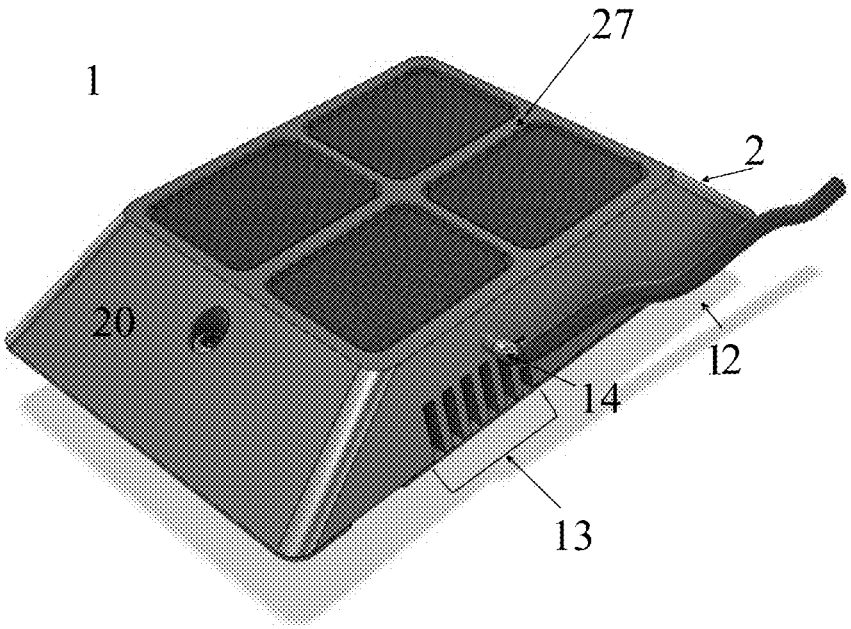
FIG. 13 is a perspective view of an embodiment of the low-profile solar-powered flood control device with a plurality of solar panel cells positioned within a recessed grid of the housing.
Figure 14:
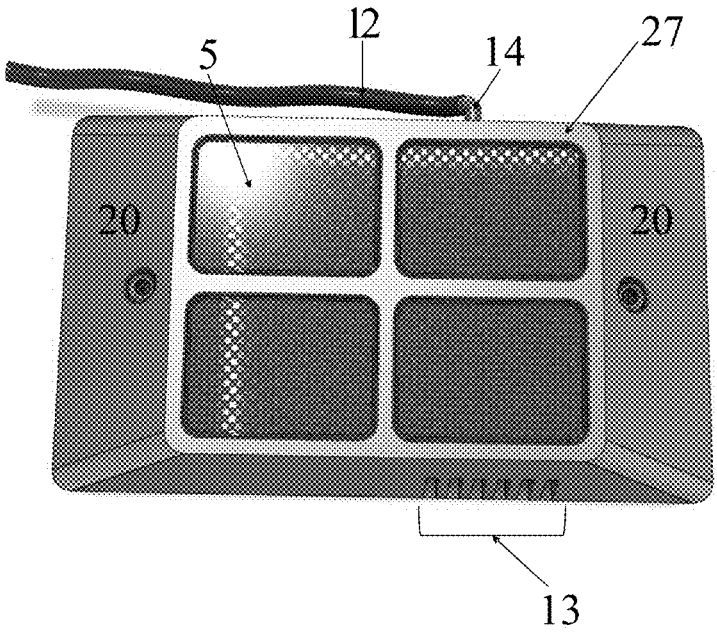
FIG. 14 is a top view of an embodiment of the low-profile solar-powered flood control device with a plurality of solar panel cells positioned within a recessed grid of the housing.

FIG. 12 provides another view of the pump compartment 17 after a filter 6 has been removed from the filter receiving space 22.

Figure 15:
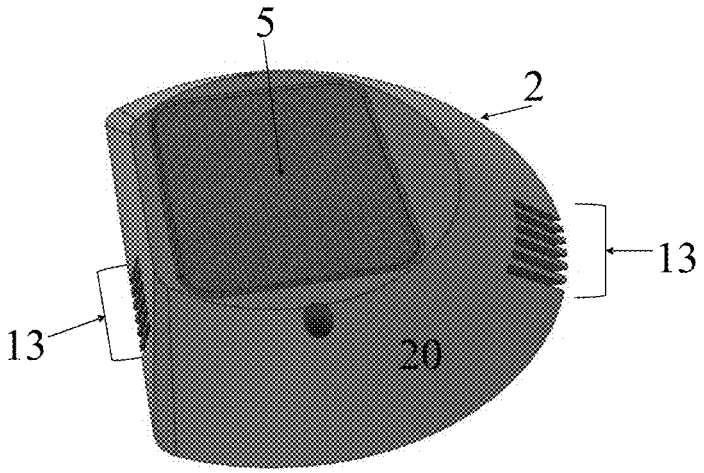
FIG. 15 is a perspective view of an embodiment of the low-profile solar-powered flood control device with a first alternate housing shape.
Figure 16:
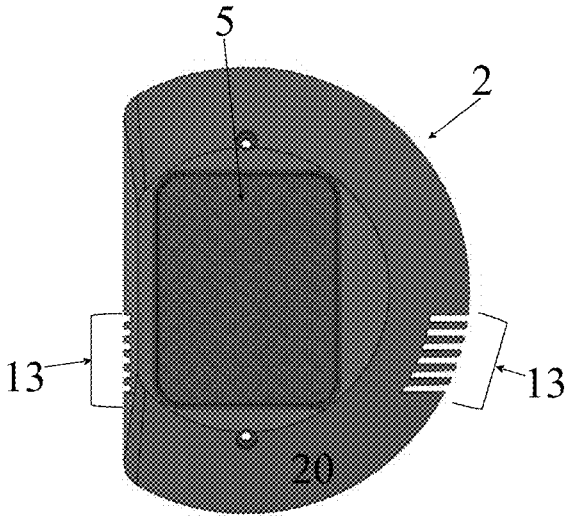
FIG. 16 is a top view of an embodiment of the low-profile solar-powered flood control device with the first alternate housing shape.
Figure 17:
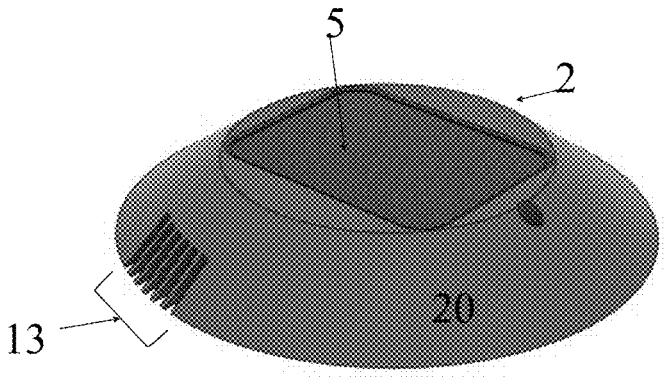
FIG. 17 is a perspective view of an embodiment of the low-profile solar-powered flood control device with a second alternate housing shape.
Figure 18:
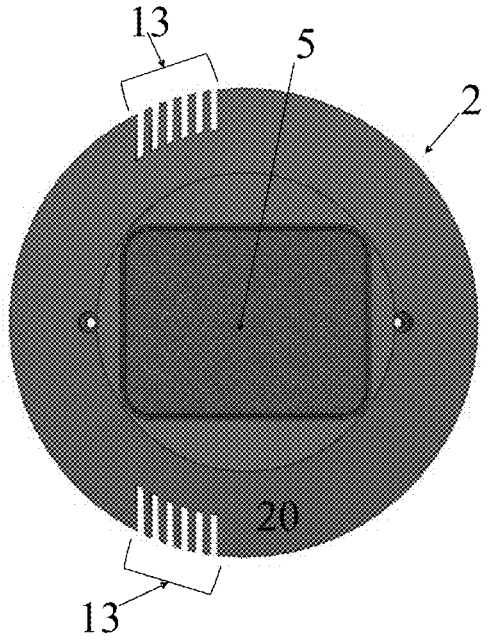
FIG. 18 is a top view of an embodiment of the low-profile solar-powered flood control device with the second alternate housing shape.

FIGS. 15 through 18 illustrate further embodiments of the low-profile solar-powered flood control device with alternative housing shapes. In the embodiment of FIGS. 17 and 18, the housing is substantially frustoconical such that the sloped sidewall 20 is continuous around the perimeter of the device. The frustoconical housing may be preferred for applications where vehicles may be likely to drive over the device at multiple angles. In the embodiment of FIGS. 15 and 16, the housing is partially frustoconical and includes one vertical sidewall and one sloped sidewall 20. The vertical sidewall of the partially frustoconical housing may be placed parallel and adjacent to a curb. It is understood that the housing shape can be adjusted for one way traffic or traffic from any angle without departing from the scope of the invention. Further, modifications to the housing shape do not necessarily require adjustments to the other components of the system, other than the mounting plate 4 and solar panel 5.

The exemplary operation of the low-profile solar-powered flood control device will now be described in further detail. The low-profile solar-powered flood control device 1 is installed in a low-lying portion of a public area that is subject to pedestrian and vehicle traffic by securing the mounting plate 4 to a surface of the low-lying area (i.e., the surface of a road) via fasteners, adhesive, or any other suitable fastening mechanism. This securement method is designed to prevent easy theft or tampering of the flood control device, which is more likely to occur in public areas, such as the curb area of a residential street. The flood control device 1 is powered by battery 7 and/or solar panel 5, which may be mounted on the flood control device housing 2 or separately secured in a location with more optimal lighting conditions. As a non-limiting example, the solar panel may be remotely mounted to a roadside light pole or other elevated platform that is subject to more sunlight. In both configurations, the solar panel 5 is connected to the battery 7 and the controller 9 housed within the flood control device.

The flood control device may include a sensor connected to the controller for determining whether water is present and turning the pump unit on or off accordingly. Examples of such sensors include relay-connected float switches, moisture detectors, open electronic contacts, or other well-known means. In various embodiments, the sensor may be positioned within the pump compartment 17, on mounting plate 4, or on cover 3. The controller 9 and/or solar panel 5 may also include means for detecting when the flood control device 1 is in poor or indirect lighting conditions. If the flood control device 1 or the solar panel 5 is in poor or indirect lighting conditions, the controller 9 may optimize battery charging accordingly. For example, the flood control device may be powered directly by solar panel 5 in optimal lighting conditions. When lighting is poor, the flood control device may instead be powered by battery 7, which is charged by solar panel 5 during periods of optimal lighting when the flood control device is not in use. Furthermore, the controller 9 can also control charging current, charging voltage, and other battery-specific optimization techniques to properly maximize the service life and charge of the battery 7.

The flood control device may further include a sensor for detecting when the controller 9, battery 7, solar panel 5, and/or pump unit 8 needs to be replaced. For example, the flood control device may include sensors that measure and detect anomalies in battery current, voltage, and/or temperature, and/or pump flow rate, speed, power use, and/or discharge pressure. The sensor may further detect if the solar panel 5 is broken, blocked, or covered with debris. The flood control device may also include a sensor for detecting whether the inlets 13 are blocked by debris and need to be serviced. As one example, the flood control device may include a sensor for detecting the presence of rising water outside of the flood control device, and one or more sensors within the pump compartment 17 or inlets 13 for detecting the flow rate of water into the flood control device. If the sensors detect an inadequate flow rate into the flood control device, the controller 9 may determine that one or more inlets 13 to the flood control device are clogged or blocked. The flood control device may further include a transmitter or transceiver for wirelessly communicating to a user device such as a smartphone when a component of the flood control device needs to be replaced or serviced.

When the sensor detects the presence of water in or around the flood control device 1, the controller 9 supplies power to the pump unit 8 and determines if the pump unit should be powered via the solar panel 5, battery 7, or both. Water flows through inlets 13 and filters 6 and pools within pump compartment 17, which may be sloped towards its center to centralize and concentrate the collection of drainage. The pump unit 8, which may be a centrifugal pump, a positive-displacement pump, or a diaphragm pump, draws water through suction funnel 21, which is positioned near the bottom of the pump compartment to enable the pump unit to draw from substantially shallow pools of water. The water passes through pump unit 8 and pump-hose connector 11, which connects the outlet of pump unit 8 to a housing outlet 14. An output hose 12 positioned outside of the flood control device housing 2 may be attached to housing outlet 14. The hose 12 conveys the drainage away from the low-lying area to a more appropriate location, such as a functioning storm water sloped region, sewer drain, retention pond, rain garden, or the like.

While some implementations have been illustrated and described, numerous modifications come to mind without significantly departing from the spirit of the disclosure, and the scope of protection is only limited by the scope of the accompanying claims. Terms such as "top," "bottom," "front," "rear," "upper," "lower," and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." Pronouns in the masculine (e.g., his) include the feminine and neuter gender (e.g., her and its) and vice versa. The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The subject matter of this specification has been described in terms of particular aspects, but other aspects can be implemented and are within the scope of the following claims.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

The disclosed systems and methods are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative implementations disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each article of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A flood control device comprising:

a low-profile housing comprising an upper cover and a lower mounting plate;

a pump unit mounted within a pump compartment of the upper cover;

a battery mounted within a battery compartment of the upper cover and connected to the pump unit;

a solar panel for supplying current to the battery; and a controller mounted within the battery compartment and connected to the solar panel, the pump unit, and the battery;

wherein the upper cover comprises at least one sloped exterior sidewall forming a ramp;

wherein the low-profile housing has an overall height that is substantially less than its width and length; and wherein the low-profile housing is configured to permit the flood control device to be safely driven over by a vehicle.

2. The flood control device of claim 1, further comprising at least one fluid inlet on the upper cover that forms a channel from an exterior of the upper cover into the pump compartment to allow the ingress of water, wherein the at least one fluid inlet is sized and arranged to prevent large debris from entering the pump compartment.

3. The flood control device of claim 2, further comprising at least one filter element disposed within the channel of the at least one fluid inlet to prevent small debris from entering the pump compartment.

4. The flood control device of claim 3, wherein the at least one filter element is disposed between an exterior wall of the upper cover and an interior wall of the upper cover that forms a vertical sidewall of the pump compartment.

5. The flood control device of claim 4, wherein the at least one filter element is removable.

6. The flood control device of claim 1, wherein the solar panel is mounted on top of the upper cover within a recess.

7. The flood control device of claim 1, wherein the solar panel is mounted separately from the housing.

8. The flood control device of claim 1, wherein the upper cover is removable from the lower mounting plate and wherein the lower mounting plate is secured to a mounting surface to prevent theft.

9. The flood control device of claim 1, further comprising a sensor that detects the presence of water near the flood control device and is connected to the controller, wherein the controller turns the pump unit on and off based on the presence of water.

10. The flood control device of claim 1, wherein the controller optimizes battery charging in poor or indirect lighting conditions.

11. The flood control device of claim 10, wherein the flood control device is powered by the battery, the solar panel, or both simultaneously depending on the lighting and weather conditions.

12. The flood control device of claim 1, wherein the pump unit is one of a centrifugal pump, diaphragm pump, or positive-displacement pump.

13. The flood control device of claim 1, further comprising a replaceable hose connected to at least one outlet in the housing for displacing water from the flood control device to an area distant from the flood control device.

14. The flood control device of claim 1, wherein a portion of the lower mounting plate that forms a bottom of the pump compartment is sloped to centralize the collection of water at an intake of the pump unit.

15. The flood control device of claim 2, wherein the fluid inlet is positioned near the bottom of the housing to facilitate collection of water from accumulated pools of water.

16. The flood control device of claim 1, wherein an intake of the pump unit is positioned near a bottom of the housing to facilitate collection of water from accumulated pools of water.

17. The flood control device of claim 1, wherein the battery compartment is potted with one of epoxy, polyurethane, and silicone potting compounds to seal the battery compartment, battery, and controller from water.

18. The flood control device of claim 1, further comprising a replacement sensor for detecting when at least one of the battery, controller, solar panel, or pump unit needs to be replaced, serviced, or repaired, and one of a transmitter or transceiver for wirelessly communicating an alarm message to a user device.

19. The flood control device of claim 18, wherein the replacement sensor detects anomalies in at least one of battery current, battery voltage, battery temperature, pump flow rate, pump speed, pump power use, pump discharge pressure, solar panel current, solar panel voltage, and solar panel efficiency.

20. The flood control device of claim 2, further comprising a debris sensor for detecting when the at least one fluid inlet is blocked by debris and needs to be cleared, and one of a transmitter or transceiver for wirelessly communicating an alarm message to a user device.

* * * * *